US011633745B2

(12) United States Patent
Woods et al.

(10) Patent No.: US 11,633,745 B2
(45) Date of Patent: Apr. 25, 2023

(54) POLYMERIZED METAL CATALYST AIR CLEANER

(71) Applicant: AMERICAIR CORPORATION, Mississauga (CA)

(72) Inventors: Jim Woods, Mississauga (CA); Gregory Inns, Oakville (CA)

(73) Assignee: AMERICAIR CORPORATION, Mississauga (CA)

( * ) Notice: Subject to any disclaimer, the term of this patent is extended or adjusted under 35 U.S.C. 154(b) by 0 days.

(21) Appl. No.: 17/672,352

(22) Filed: Feb. 15, 2022

(65) Prior Publication Data

US 2022/0168752 A1 Jun. 2, 2022

Related U.S. Application Data

(62) Division of application No. 16/416,641, filed on May 20, 2019, now Pat. No. 11,285,491.

(51) Int. Cl.
*B03C 3/155* (2006.01)
*B03C 3/12* (2006.01)

(52) U.S. Cl.
CPC ..... *B03C 3/155* (2013.01); *B03C 3/12* (2013.01)

(58) Field of Classification Search
CPC combination set(s) only.
See application file for complete search history.

(56) References Cited

U.S. PATENT DOCUMENTS 2,575,181 A * 11/1951 Mack ..... B03C 3/47 52/581
2,973,054 A * 2/1961 Kurtz ..... B03C 3/155 96/66
3,740,927 A * 6/1973 Vincent ..... B03C 3/09 96/54

(Continued)

OTHER PUBLICATIONS

Lennox Industries Inc.; Homeowners IAQ Guide for PUREAIRtm Models PCO-12C, PCO-20C, 4 pages, 2001.

*Primary Examiner* — Christopher P Jones
*Assistant Examiner* — Sonji Turner
(74) *Attorney, Agent, or Firm* — Roach Brown McCarthy & Gruber, P.C.; Kevin D. McCarthy

(57) ABSTRACT

A method of making an electronic air filter that requires obtaining a first metallic plate comprising copper and a second metallic plate comprising copper. The method also requires creating a first pattern of slits through the first metallic plate's thickness and a second pattern of slits through the second metallic plate's thickness and expanding (a) the first slitted metallic plate to form a first aperture metallic plate and (b) the second slitted metallic plate to form a second aperture metallic plate wherein when the first aperture metallic plate and the second aperture metallic plate are properly aligned and positioned in an electronic air cleaner device then the apertures in the first aperture metallic plate and the apertures in the second aperture metallic plate misalign or do not align with each other. Another requirement is that the method calls for applying a dielectric conducting and antimicrobial agent polymer material to (a) the first aperture metallic plates to form a first coated, aperture metallic plate and (b) the second aperture metallic plates to form a second coated, aperture metallic plate.

20 Claims, 15 Drawing Sheets

(56) References Cited

U.S. PATENT DOCUMENTS

| | | | | |
|---|---|---|---|---|
| 3,820,306 | A * | 6/1974 | Vincent | B03C 3/09 96/54 |
| 3,966,442 | A | 6/1976 | Waters | |
| 4,133,658 | A | 1/1979 | Callewyn | |
| 5,622,543 | A * | 4/1997 | Yang | B03C 3/368 96/58 |
| 5,730,282 | A | 3/1998 | Bureau | |
| 7,267,712 | B2 * | 9/2007 | Chang | B03C 3/09 96/77 |
| 7,306,650 | B2 | 12/2007 | Slayzak et al. | |
| 9,550,189 | B2 * | 1/2017 | Oertmann | B03C 3/41 |
| 9,789,494 | B2 * | 10/2017 | Wiser, III | F24F 8/192 |
| 10,357,781 | B2 * | 7/2019 | Luo | B03C 3/09 |
| 2002/0173265 | A1 | 11/2002 | Kipka | |
| 2007/0144119 | A1 | 6/2007 | Bauer | |
| 2008/0311602 | A1 | 12/2008 | Wang et al. | |
| 2011/0115415 | A1 * | 5/2011 | Hong | B03C 3/41 315/326 |
| 2013/0312451 | A1 | 11/2013 | Max | |
| 2014/0150488 | A1 | 6/2014 | Black | |
| 2015/0113924 | A1 | 4/2015 | Matthews | |

* cited by examiner

POLYMERIZED METAL CATALYST AIR CLEANER

PRIORITY CLAIM

This application is a divisional application of U.S. patent application Ser. No. 16/416,641 that was filed on May 20, 2019.

FIELD ON THE INVENTION

The present invention directed to an air cleaner device.

BACKGROUND OF THE INVENTION

Air is a significant factor in disseminating pathogens with food processing and clinical environments. To date, a preferred air decontamination approach is to use a high-efficiency particulate air ("HEPA") filter used in association with other components of an air filtration device to physically remove microbes from air streams.

Americair Corporation, the assignee of this application, is the manufacturer of numerous HEPA air filtration devices, each of which has a housing. Each housing has an air inlet and an air outlet, and within the housing is, at a minimum, a HEPA air filter. The housing may have a fan/motor or if the HEPA air filtration device is interconnected to ductwork wherein a fan/motor is positioned outside of the housing and pushes or pulls air through the ductwork and HEPA air filtration device. In either embodiment, the fan/motor draws or pushes, depending on the location of the fan/motor, air through, at a minimum, the air inlet, the HEPA air filter, and the air outlet. In some HEPA air filtration devices, the fan/motor draws or pushes the air through (a) the air inlet (b) a multi-part HEPA filter having, for example (b.1) a pre-filter, that can be made of foam, that removes large air-borne particulates such as dust and dander from the air stream that enters the HEPA air filtration device, (b.2) the HEPA filter that is laser tested to capture (and thereby remove) 99.97% of the particles in the air stream that enters the HEPA air filtration device down to a size of 0.3 microns—particles of concern that are normally in this size range include and not limited to pollen, household dust, cigarette smoke particulates, bacteria, molds, etc.;

(b.3) an inner blanket of activated carbon impregnated with non-woven polyester filter material that absorbs additional gaseous contaminants such as odors and toxic fumes; and (c) the air outlet.

For this application, the above-identified HEPA air filter and the above-identified multi-part HEPA air filter are, in this application, commonly referred to as a HEPA air filter.

Every HEPA air filtration device has the following characteristics: (1) the housing with the air inlet, the air outlet, and the HEPA air filter wherein the housing is subject to the effects of the fan/motor device, positioned within (preferably, within) or outside the housing, that pulls or pushes air though the housing, and (2) the HEPA air filter system is designed to capture (and thereby remove) 99.97% of the particles having a size of 0.3 microns or greater from the air streaming through the HEPA air filter device.

An alternative air filtration device is an UV/ionizing based device. The UV/ionizing device can have a retention time that is, normally, too short to ensure microbial inactivation. Accordingly, the UV/ionizing device has obvious shortcomings that will not be addressed in this application.

Another alternative air filtration device is an electronic air cleaner, sometimes referred to as an ionizer device or an electronic air purifier device. Standard operating features of an electronic air cleaner involve electrically charged filters that reduce the number of airborne contaminants in a building. As air passes through the building's heating and cooling system, the electronic air cleaner is positioned to receive that air before the air is released into the building's air breathing environment. The electronic air cleaner device normally has (a) a prefilter that traps large particles such as dust and dander, and (b) at least one electrically charged filter (or referred to as an electrostatic air filter) that attracts and traps smaller particles such as bacteria and mold in order to inhibit those smaller particles from recirculating through the building and into the building's air breathing environment.

The electrically charged filter is washable. The washable electrically charged filter, normally, has multiple layers of vented metal that permits air to pass through. As the air and the air-borne particulates pass through the first layer (s) of the electrically charged filter, the air-borne particulates of the air stream are positively charged by the friction generated between the air stream in the electronic air cleaner device and the first layer(s) of the electrically charged filter in the electronic air cleaner device. Once the air-borne particulates from the air stream in the electronic air cleaner device are positively charged as described above, then the positively charged air-borne particulates are supposed to attach themselves to the next few layers of the electrically charged filter as the air stream passes through the remaining layers of the electrically charged filter in the electronic air cleaner device. In other words, the first layer (s) of the electrically charged filter is supposed to create a charge on the air-borne particles in the air stream that contacts or is in the area of the first layer(s) of the electrically charged filter in the electronic air cleaner device and then the next layers cf the electrically charged filter are designed to trap those charged air-borne particles prior to the air stream exiting the electronic air cleaner device through the outlet.

Admittedly, electrically charged filters can only filter so much. One problem with electrically charged filters is that it relies on static electricity to operate. Static electricity is normally sufficient to filter small, lighter dust particles out of the air. Static electricity, however, has problems capturing larger dust and dirt particles, and mold spores. That is one reason why a pre-filter is used with prior electrically charged filters in electronic air cleaner device to increase the capture rate of those larger air-borne particulates. It is also known that an electrically charged filter has difficulty filtering as well as a high quality HEPA filter or even a moderate 1200 micro particle performance (MPR) rated filter.

Lennox wrote in its HOMEOWNERS IAQ GUIDE FOR PUREAIR™ MODELS PCO-12C, PCO-20C—which it describes as its electronic air cleaner, sometimes referred to as an ionizer device or an electronic air purifier device—the following: "The PureAir™ air purification system helps to significantly reduce levels of airborne volatile organic compounds, cooking odors, common household odors, airborne dust particles and mold spores, and pollen in residential spaces. The PureAir™ air purification system includes a MERV 9 Pleated Filter, UVA lamps, and a Metal Insert that is coated with a titanium dioxide catalyst. As air enters the system, a percentage of airborne particles and bioaerosols, such as mold and bacteria, larger than 0.3 microns are captured by the pleated filter. The smaller airborne particles, odors, and chemicals continue through the system. The UVA lamp activates the catalyst on the Metal Insert. The catalyst combines with water vapor in the air to form hydroxyl radicals that destroy a percentage of the remaining odors and chemicals."

In U.S. Pat. No. 7,306,650; Slayzak et al. disclosed a method and systems for purifying and conditioning air of weaponized contaminants. The method called for wetting a filter packing media with a salt-based liquid desiccant, such as water with a high concentration of lithium chloride. Air is passed through the wetted filter packing media and the contaminants in the air are captured with the liquid desiccant while the liquid desiccant dehumidifies the air. The captured contaminants are then deactivated in the liquid desiccant, which may include heating the liquid desiccant. The liquid desiccant is regenerated by applying heat to the liquid desiccant and then removing moisture. The method includes rewetting the filter media with the regenerated liquid desiccant which provides a regenerable filtering process that captures and deactivates contaminants on an ongoing basis while also conditioning the air. The method may include filtration effectiveness enhancement by electrostatic or inertial means.

In some of Slayzak's disclosures, the capture effectiveness of the air filtration device can be improved by the addition of one or more components in the conditioner portion to treat contaminants in the intake air and/or to create desired flow characteristics in a conditioner tower. One technique of improving the capture function of the air filtration device was to implement an electrically charged filter within the tower that uses the precipitation principle to collect airborne particles. Generally, Slayzak's air filtration device could be modified to include one or more of the known types of electrically charged filters. The task of implementing one of these electrically charged filters is complicated by the fact that salt solutions severely corrode most metals. Using the filter packing media itself is an option that could be utilized such as by implementing a charged-media non-ionizing filter or a charged-media ionizing filter. The packing in media may be formed of titanium (but this is an expensive solution) or electronically conductive plastics or polymer coatings like polyaniline, polyacetylene, polythiophene, fluorophenylthiophene, polypyrrole, and electro-luminescent polymers may be used.

Those polymers, as described in alternative embodiments by Slayzak, could be coated to wicking filter plates that do not charge air contaminants. In particular, Slayzak wrote, "As with the packed tower configurations . . . , the system . . . preferably includes one or more components to enhance capture of contaminants that may be used individually or in various combinations. As shown, the system . . . includes a pretreatment device . . . , a charger . . . , and an inertial filtration enhancement component . . . on the upstream side of the wicking filter . . . and a precipitator . . . downstream of the wicking filter . . . . As with the systems of FIGS. 1-4, the charger . . . and precipitator . . . act in conjunction to ionize contaminants in air . . . and to attract and then capture charged contaminants. Note, the parallel plate configuration of the wicking filter . . . is more similar to conventional electronic air filter designs, which lends the media of the filter . . . to being used as a single stage [electrostatic precipitator] (or the liquid desiccant itself can act as the collection surface when the contaminants are ionized). In such embodiments of the system . . . , the plates of the wicking filter . . . can be made of conductive plastic or the plates may be coated with conductive, corrosion-resistant materials or flocking (or even the adhesive for the flocking) that forms the wicking surface on the plates may be conductive. Alternatively, the plates, the flocking, and/or the adhesive can be modified with carbon black or other conductor to make the plate surfaces suitable for electrostatic enhancement."

As expressed at U.S. Pat. No. 7,306,650, the corrosion issues were addressed in the system by implementing an ionizing-type electronic air filter in a conditioner having two parts (although in some embodiments a single stage electrostatic precipitator may be installed downstream of the filter packing media and preferably downstream from the mist eliminator). A charger is provided in the conditioner between the air intake and the tower (although charging could be performed within the media). The incoming air passes through a series of high-potential ionized wires (or plates) in the charger that generate positive ions that adhere to the contaminants carried in the air. The air with charged contaminants then passes through the filter packing media where some enhancement of capture can be expected due to the greater attraction of the ionized contaminants with the liquid desiccant on the media surfaces. In addition, an electrostatic precipitator is provided, downstream of the mist eliminator and the filtered air is passed through the electrostatic precipitator. The electrostatic precipitator may take a number of forms and configurations but generally, the charged contaminants are passed through an electric field in the precipitator that attracts the charged contaminants to attracting plates (or grids and the like). The plates typically are arranged to offer little resistance to air flow and are typically evenly distributed in the precipitator. The plates may be coated with water to act as an adhesive for the charged contaminants, and the plates are periodically cleaned by use of water or other liquid sprayed on the plates of the precipitator which drains into a sump.

SUMMARY OF THE INVENTION

A polymerized metal catalyst air cleaner has a housing. The housing has an inlet, an electrically charged air filter, and an outlet. A fan is either in the housing or effects the air going into and out of the housing by pulling or pushing air (a) into the inlet, (b) through the electrically charged air filter, and (c) through the outlet. The electrically charged air filter has a first metallic plate, a second metallic plate and at least a first frame unit that secures, at least, the first metallic plate and, optionally, a second metallic plate in a proper position in the housing so the air stream in the air filtration device must pass the electrically charged air filter as desired.

The first metallic plate (a) has first specific dimensions of length, width and thickness, (b) is coated with a layer of a dielectric conducting and antimicrobial agent polymer material, and (c) has a first plurality of apertures.

Similarly, the second metallic plate (a) has second specific dimensions of length, width and thickness, (b) is coated with a layer of the dielectric conducting and antimicrobial agent polymer material, and (c) has a second plurality of apertures.

When securely and properly positioned in the housing, the second plurality of apertures do not align or are misaligned (preferably the former to increase air flow resistance in the air filter) with the first plurality of apertures. The frame unit ensures the first and second metallic plates are properly positioned in the housing.

DETAILED DESCRIPTION OF THE INVENTION

Figure 7:
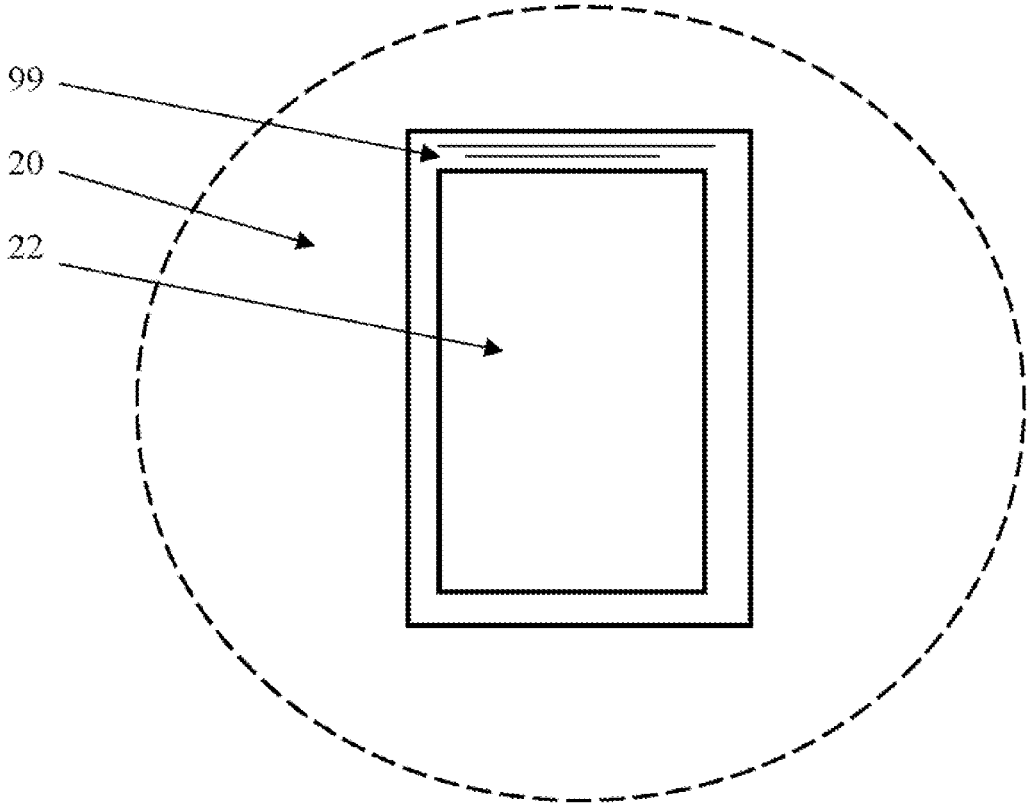
FIG. 7 is an enlarged portion of FIG. 2 identified by dashed circle 7 that illustrates a strand 99 from an aperture 22.

The current invention is directed toward a polymerized metal catalyst air cleaner device 9 having an electrically charged air filter unit. Each electrically charged air filter unit has at least two metallic plates, and each metallic plate has a width (w), length (l) and thickness (h), wherein the thickness is ultrathin and has a thickness that ranges from 10 microns to 10 millimeters, or 50 microns to 5 millimeters, or 100 microns to 3 millimeters or 500 microns to 2 millimeters. The width and length of each metallic plate defines an air contacting surface 12 and an air releasing surface 14 wherein the air contacting surface and the air releasing surface are separated by the thickness of each metallic plate. The metallic plate is copper plated steel, copper, or copper alloy; and contains numerous apertures 22 or 42 that extend from the metallic plate's air contacting surface 12 to the air releasing surface 14. Each metallic plate in the current invention is commonly called expanded metal. Expanded metal is conventionally described (for example, at www.metalsupermarkets.com) as follows > "Expanded metal sheet is made by first creating multiple slits in the sheet, and then stretching the sheet. The stretching creates a unique diamond pattern opening with one of the strands (99 as shown in FIG. 7) protruding at a slight angle. These raised strands can be flattened later in the process if desired. As you can see this process creates no waste (thus keeping down production costs) and it can add structural strength to the product . . . . One of the benefits from the manufacturing of expanded metal is that the sheet retains its structural integrity because it has not undergone the stress of having shapes punched in it (like perforated sheet), and the mesh-like pattern will not unravel (like woven mesh can do). Expanded metal has been stretched rather than punched, reducing scrap metal waste; making it cost-effective. The main considerations when using expanded metal will be the chosen thickness and strand dimensions (weight and structural design requirements). Expanded metal can be almost transparent (depending on the opening); it has mechanical properties and is an excellent conductor . . . . Expanded metal sheet works well for steps, flooring in factories and on construction rigging, fences, wash stations, and security applications."

Figure 2:
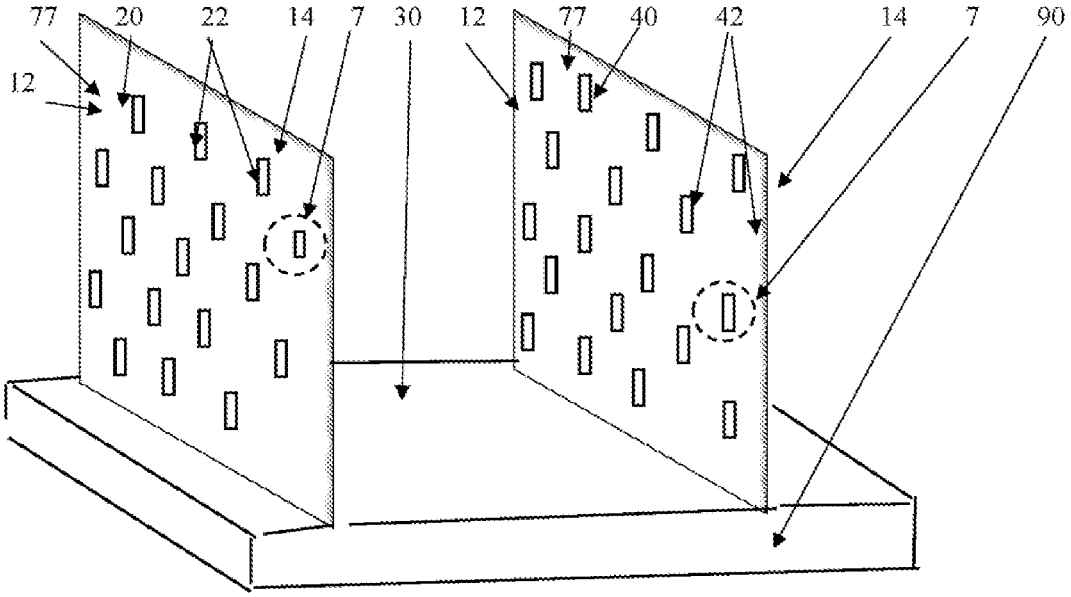
FIG. 2 is an illustration of one embodiment in which filters are securely, and properly positioned in the electronic air cleaner device without showing the housing.
Figure 4:
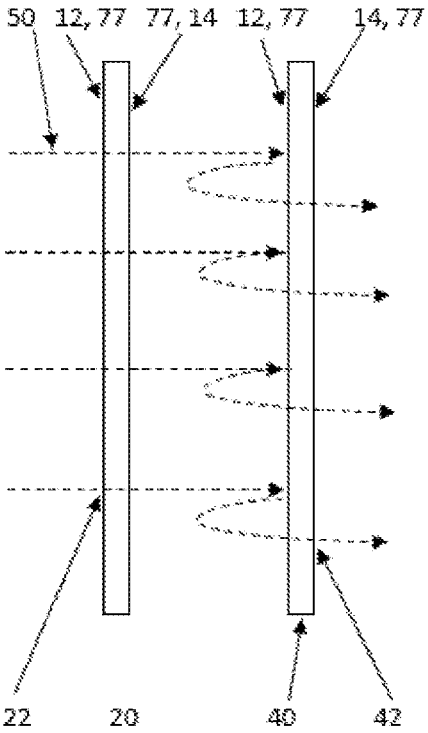
(Prior Art) Figure 4
FIG. 4 illustrates air passing through electronic air filter metallic plates wherein the apertures of a first plate are mis-aligned or non-aligned with apertures of a second plate.
Figure 5A:
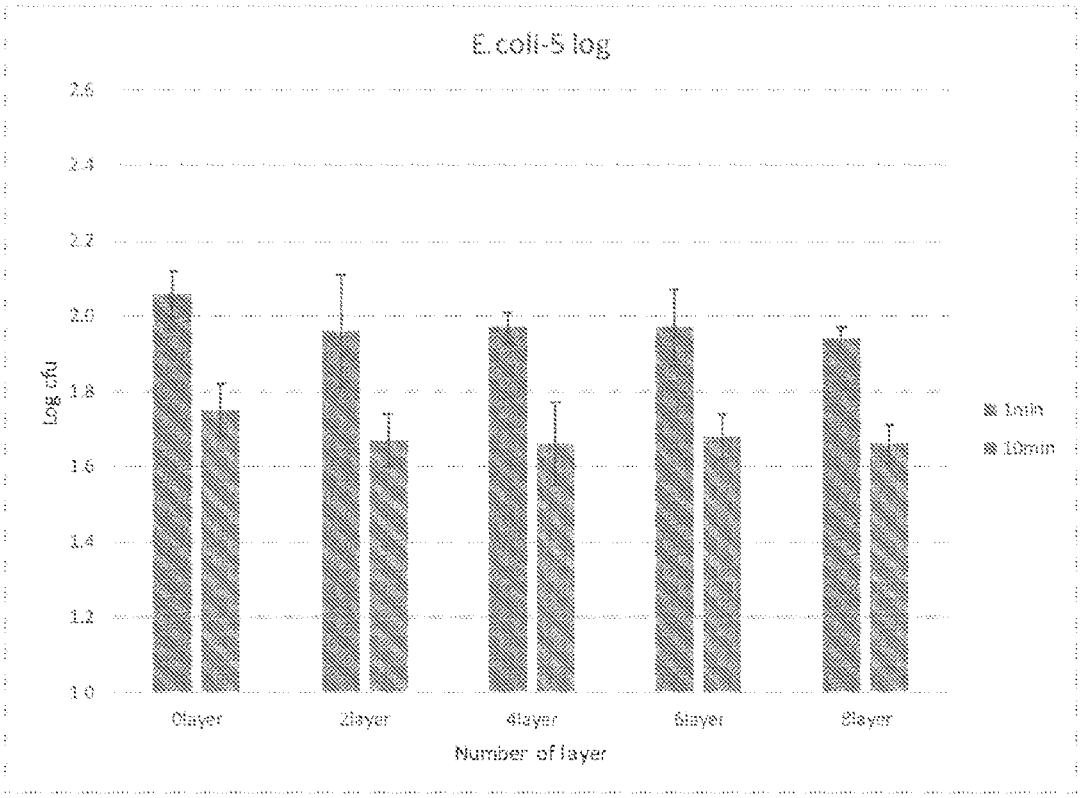
FIG. 5A is a graph illustrating the microorganisms collected after coated metallic apertured air filter plates (*E. coli* with 5 log cfu of initial loading).
Figure 5B:
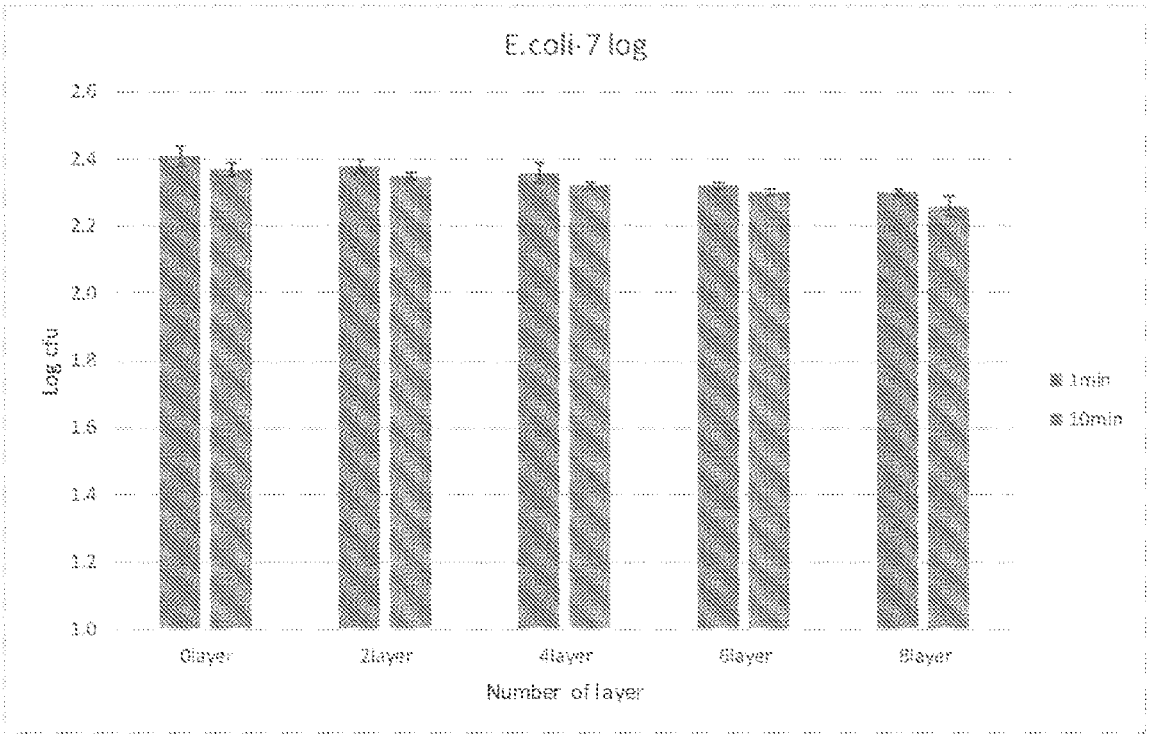
FIG. 5B is a graph illustrating the microorganisms collected after coated metallic apertured air filter plates (*E. coli* with 7 log cfu of initial loading).
Figure 5C:
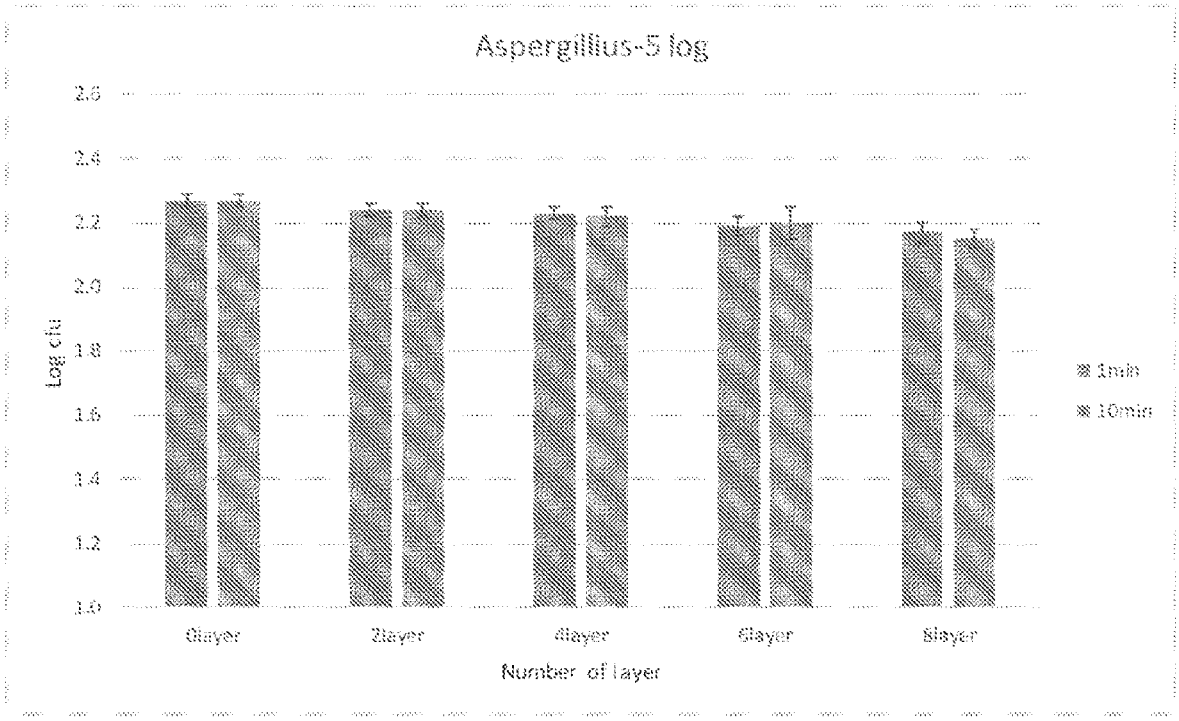
FIG. 5C is a graph illustrating the microorganisms collected after coated metallic apertured air filter plates (*Aspergillus niger* with 5 log cfu of initial loading).
Figure 5D:
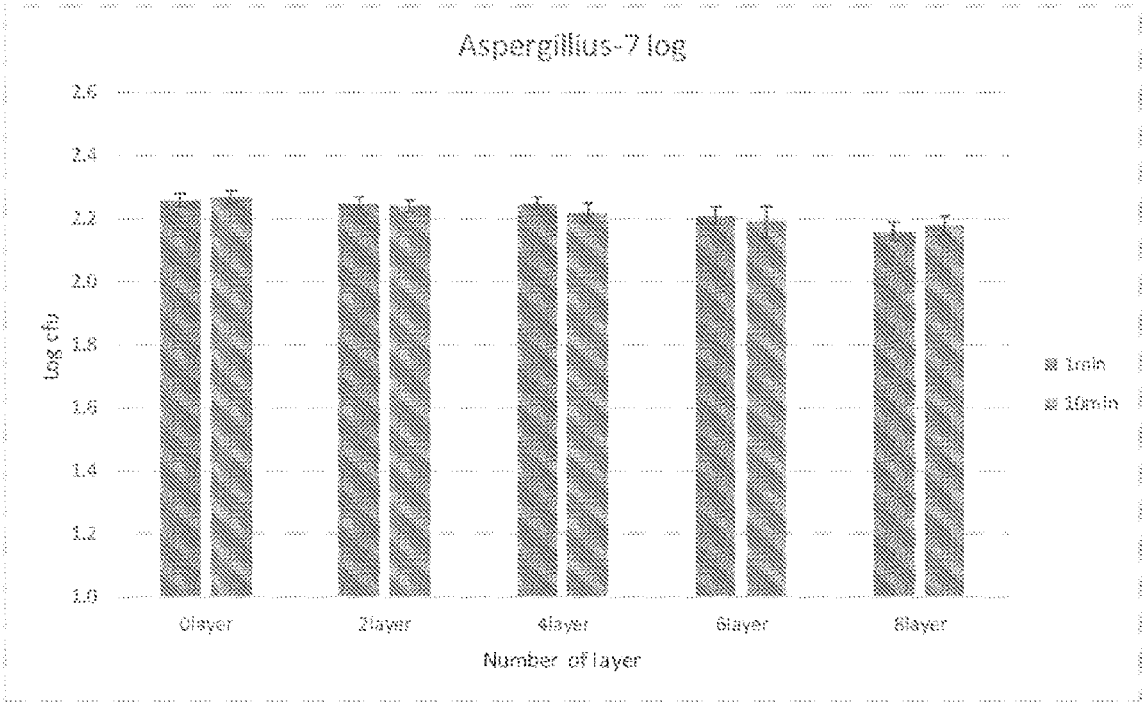
FIG. 5D is a graph illustrating the microorganisms collected after coated metallic apertured air filter plates (*Aspergillus niger* with 7 log cfu of initial loading).
Figure 6A:
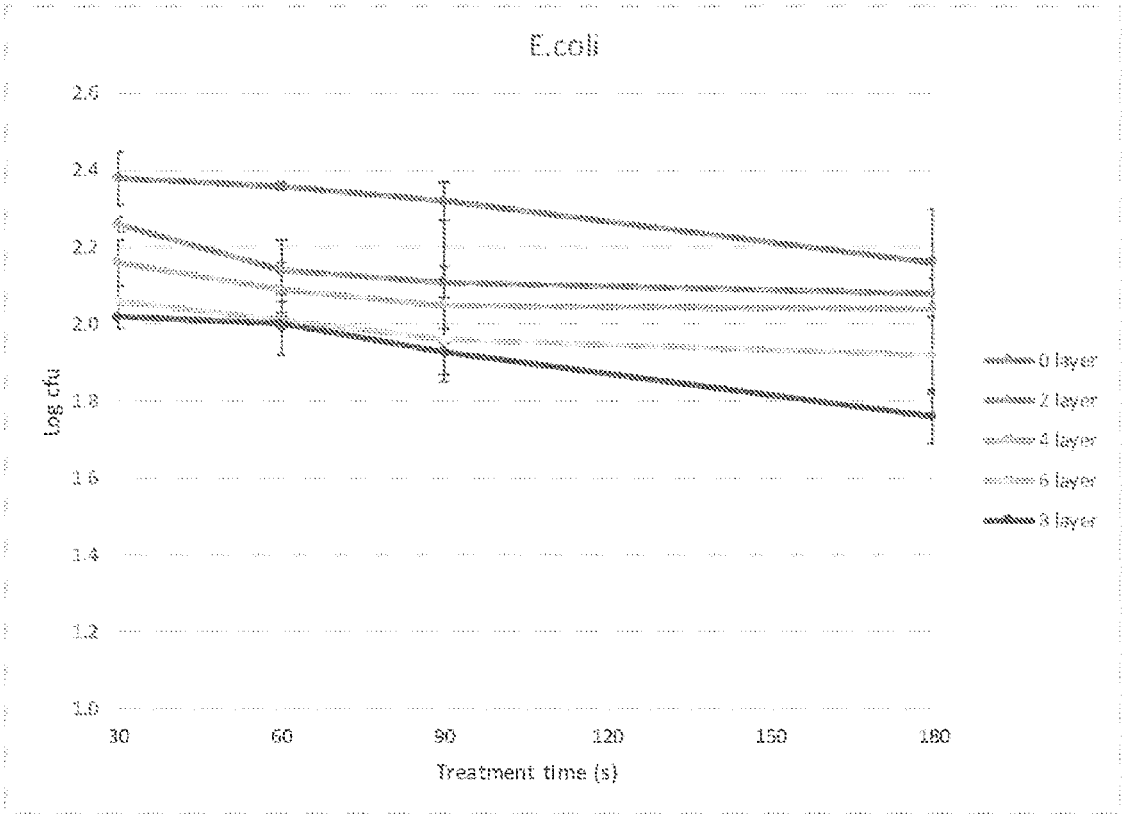
FIG. 6A is a graph illustrating the microorganisms collected after coated metallic apertured air filter plates (*E. coli* with 7 log cfu of initial loading).
Figure 6B:
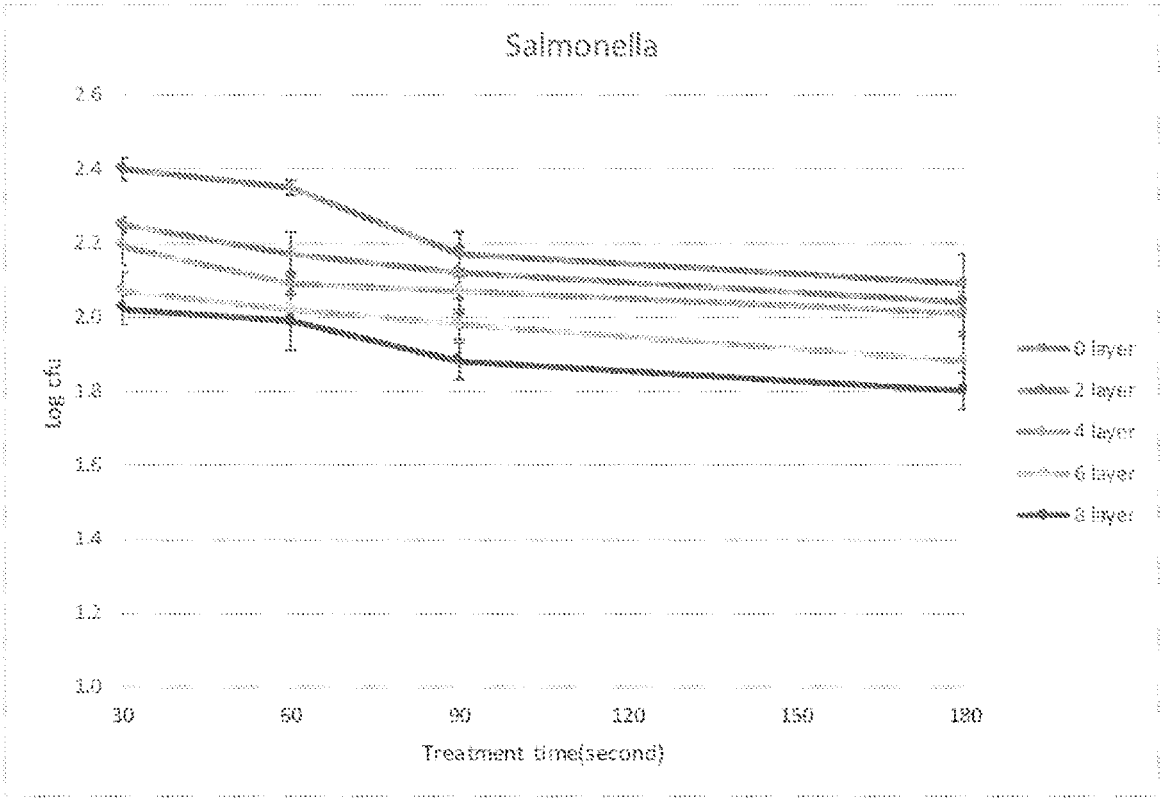
FIG. 6B is a graph illustrating the microorganisms collected after coated metallic apertured air filter plates (*Salmonella enterica* with 7 log cfu of initial loading).
Figure 6C:
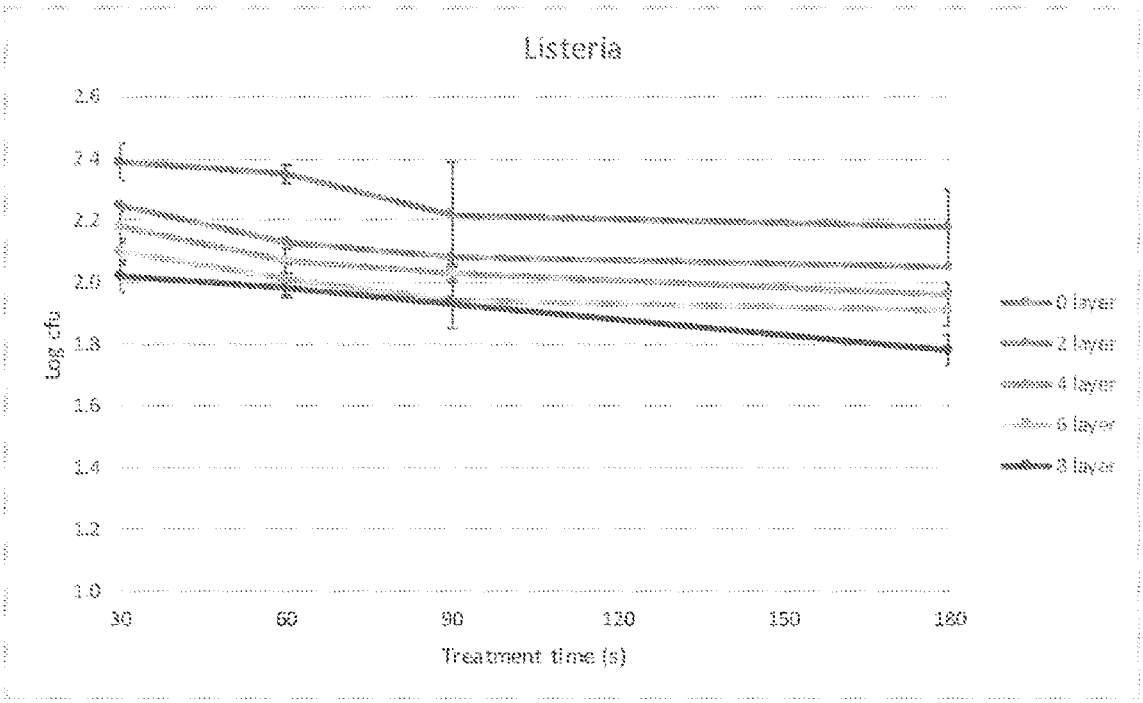
FIG. 6C is a graph illustrating the microorganisms collected after coated metallic apertured air filter plates (*Listeria monocytogenes* with 7 log cfu of initial loading).
Figure 6D:
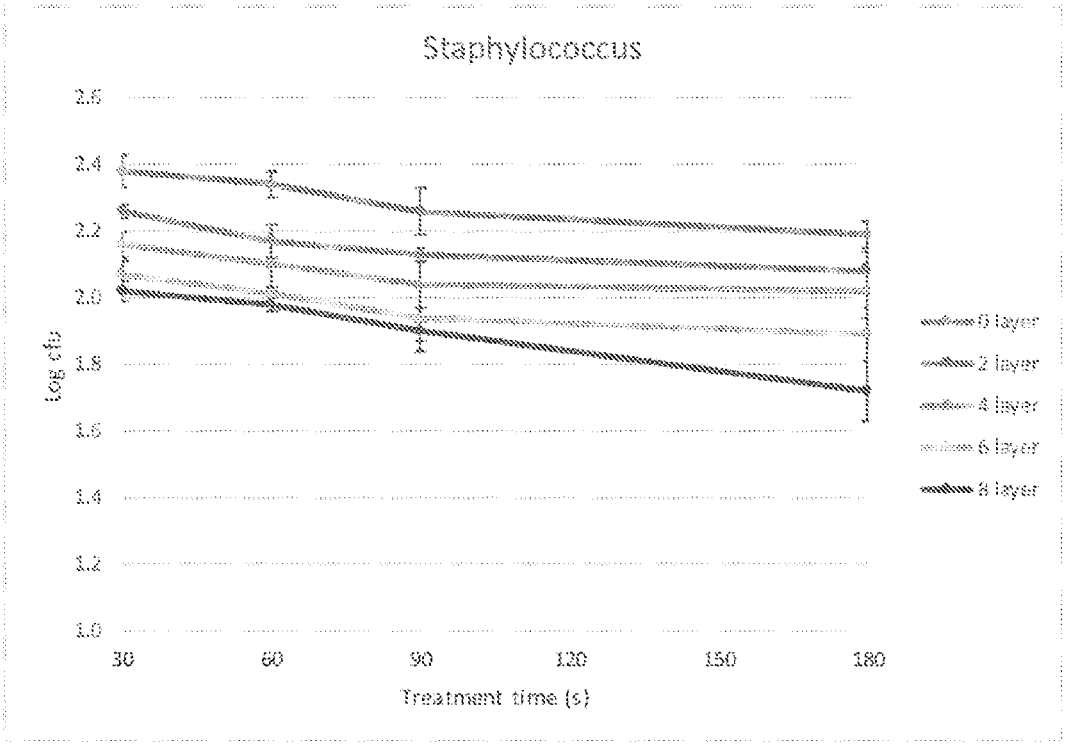
FIG. 6D is a graph illustrating the microorganisms collected after coated metallic apertured air filter plates (*Staphylococcus aureus* with 7 log cfu of initial loading).
Figure 6E:
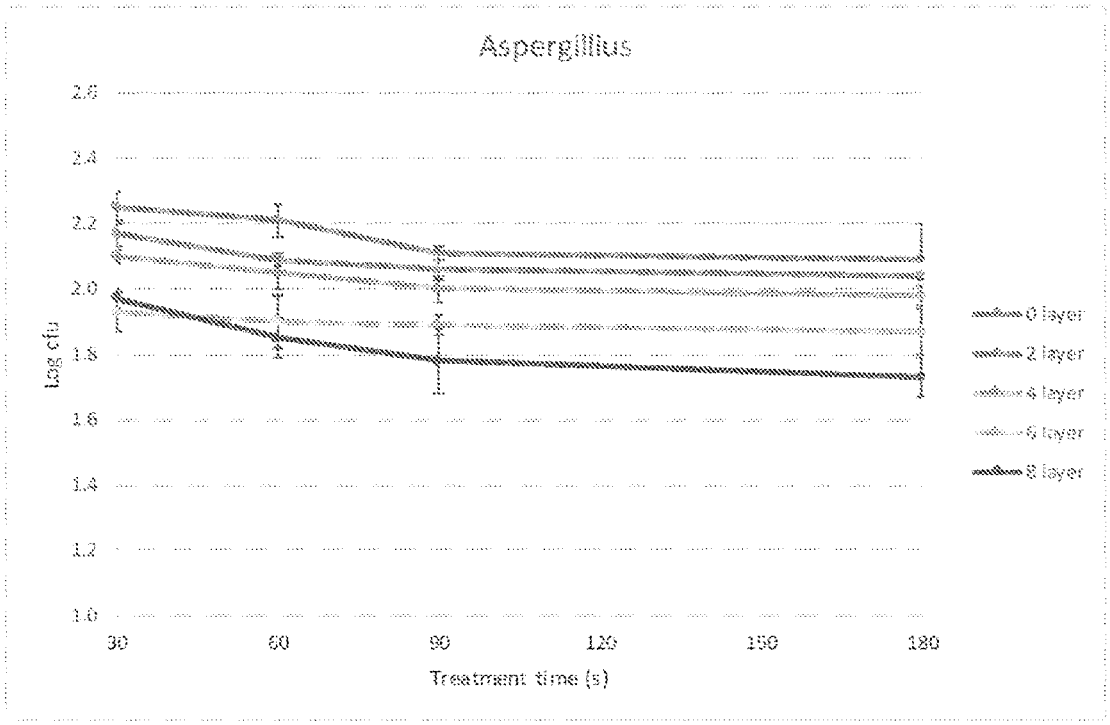
FIG. 6E is a graph illustrating the microorganisms collected after coated metallic apertured air filter plates (*Aspergillus niger* with 7 log cfu of initial loading).
Figure 6F:
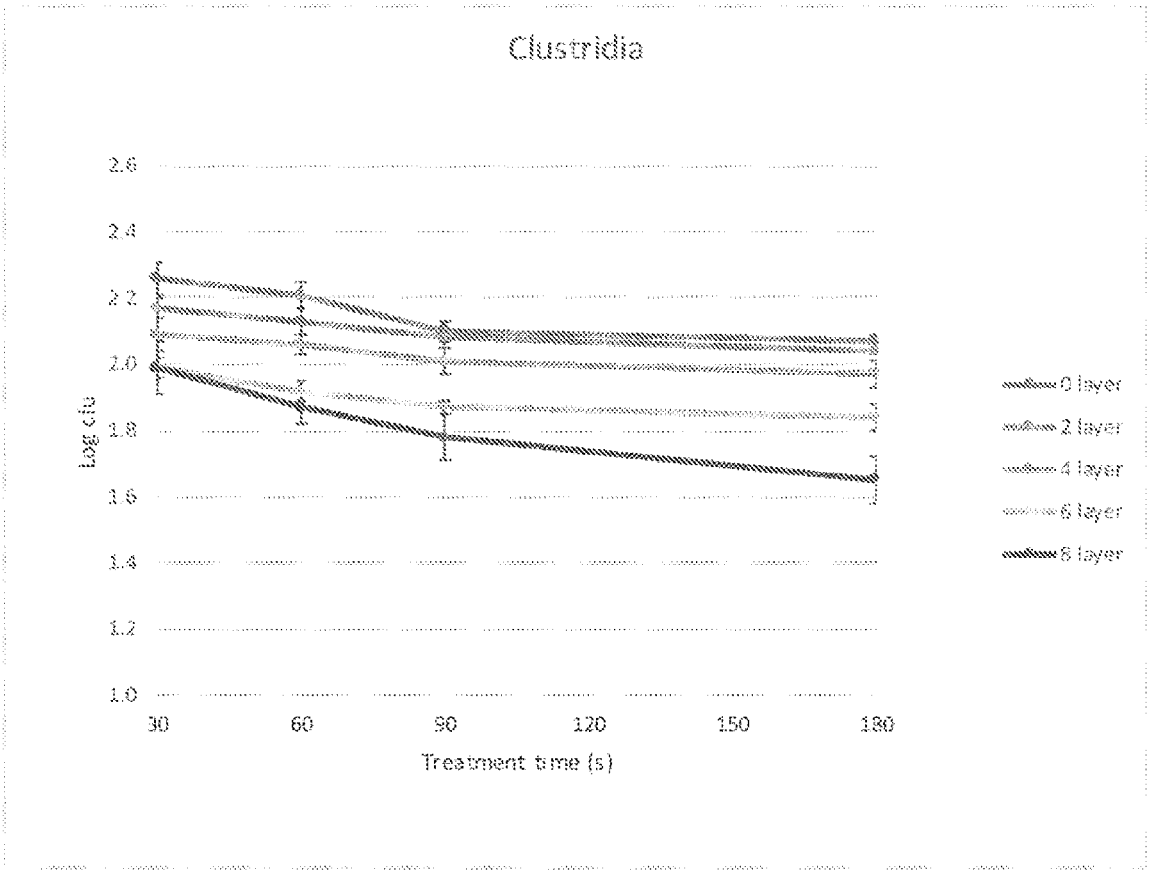
FIG. 6F is a graph illustrating the microorganisms collected after coated metallic apertured air filter plates (*Clostridia perfringens* with 7 log cfu of initial loading).
Figure 6G:
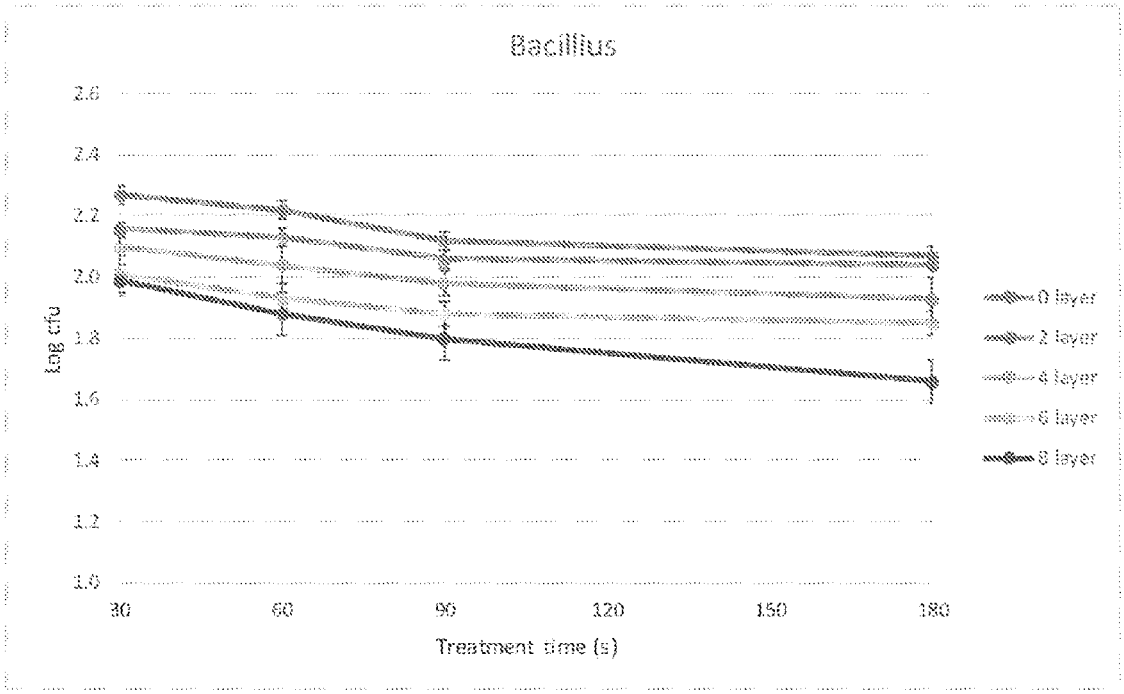
FIG. 6G is a graph illustrating the microorganisms collected after coated metallic apertured air filter plates (*Bacillus subtilis* with 7 log cfu of initial loading).

The apertures permit air to pass through the metallic plates and the metal forming the apertures are sized to capture air-borne particulates. Preferably, the captured air-borne particulates are equal to or greater than 0.3 microns. As illustrated at FIGS. 2 and 4, there are at least two thin electrically charged air filter metallic plates with the understanding that more thin electrically charged air filter metallic plates can be used in the polymerized metal catalyst air cleaner device 9.

Figure 3:
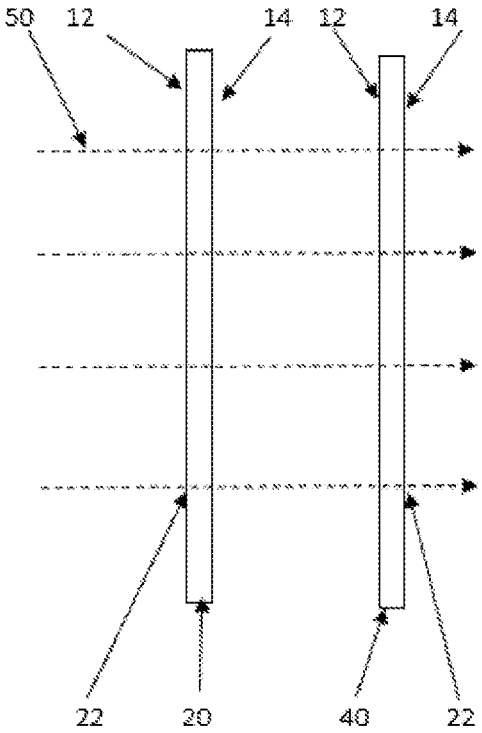
FIG. 3 illustrates a prior art embodiment of air passing through electronic air filter metallic plates having aligned apertures.

The apertures 22 of the first thin electrically charged air filter metallic plate 20 are misaligned or not aligned with the apertures 42 of the second and adjacent thin electrically charged air filter metallic plate 44. Aligned apertures are illustrated at FIG. 3 wherein the first metallic plate 20 and the second metallic plate 40 have the identical placement of the apertures 22 so air (identified as broken arrows 50) can easily pass from first metallic plate apertures through second metallic plate apertures since the apertures are aligned. Misaligned or not aligned apertures are illustrated at FIGS. 2 and 4 wherein the first metallic plate has apertures 22 and the second metallic plate has apertures 42 so air 50 does not as easily pass from first metallic plate apertures through second metallic plate apertures as a result of increased air turbulence (shown by the broken line 50). The turbulent air between the plates is illustrated by the air contacting the second metallic plate air contacting surface 12 and then bouncing back to exit one of the second metallic plate apertures 42. That increased turbulence increases the charging of the air particulates which in turn increases capturing air particulates from the air. Misalignment potentially has some alignment between portions of the first apertures 22 and portions of the second apertures 42, and non-alignment has no alignment between the first and second apertures 22, 42. Obviously, turbulence can be altered based on whether the first and second apertures 22, 42 are mis-aligned or non-aligned. Accordingly, the manufacturer and user can determine which type of turbulence is desired, and in many instances, it is the greater turbulence to remove more air particulates from the air that is desired.

For this paragraph, lets assume there is a first aperture on a first electrically charged air filter metallic plate and a second aperture on a second electrically charged air filter metallic plate, wherein the first aperture and the second aperture essentially correspond with other. Based exclusively on that assumption, we will discuss misalignment values. A 10% misalignment value means 90% of the first aperture on the first electrically charged air filter metallic plate aligns with 90% of the second aperture on the second electrically charged air filter metallic plate.

As a result, a 10% misalignment value does not cause much turbulence since the 90% of the air, assuming the air is going in a straight line, passes through the first aperture and the second aperture with little to no turbulence. Obviously, 10% misalignment is not desired. Instead, the misalignment values ranging from 40% to 99% are desirable, and misalignment values 50% to 99% create greater turbulence than 40% to 99%; 60% to 99% create greater turbulence than 50% to 99%; 70% to 99% create greater turbulence than 60% to 99%; 80% to 99% create greater turbulence than 70% to 99%; 90% to 99% create greater turbulence than 90% to 99%; and 95% to 99% creates the most turbulence in a misalignment setting of the apertures. In this invention, greater turbulence between the electrically charged air filter metallic plates is desirable.

The apertures misalignment or non-alignment configuration is applied for each adjacent electronic metallic plate used in the claimed invention wherein it is preferred that no metallic plate in the air filtration device's housing 10 (see, FIG. 1) has the same aperture configuration in order to maximize the air stream turbulence in the housing 10. That being said, it is acceptable if the metallic plates in the housing 10 have the same aperture alignment on the condition that metallic plates adjacent to each other do not have the same aperture alignment. It is preferred that if the metallic plates in the same housing 10 have the same aperture alignment then the metallic plates having the same aperture alignment should be spaced as far apart from each other to increase the turbulence within the electrically charged air filter unit.

In addition, misaligning the filter plates increase the chances of mechanical filtration mechanisms (impingement, interception, and diffusion) occurring Impingement occurs by changing the direction of the air flow causing the particles to be carried into the filter strands due to their momentum (i.e. speed, weight, size Interception occurs by changing the direction of the air flow as well. The smaller particles follow the air steam but still come into contact with the filter strand as it passes around it.

Diffusion (Brownian Motion) occurs when very small particles have an erratic path caused by being bombarded by other molecules in the air. The erratic path of the particles increases the chance that they will be captured by the filter strands.

Each electrically charged air filter metallic plate has a layer 77 of a dielectric conducting, antimicrobial polymer material. The layer of dielectric conducting, antimicrobial polymer material is coated onto the metallic apertured air filter plate. The desired thickness of the dielectric conducting, antimicrobial polymer material on the metallic plate ranges from 1 micron to 4 millimeters thick.

The dielectric conducting and antimicrobial agent polymer material coated on metallic apertured air filter plate, as called for in this application, obtains superior results compared to an uncoated metallic apertured air filter plate. Table 1 illustrates the results of (1) (a) an air cleaner device having 2, 4, 6, and 8 layers of uncoated metallic apertured air filter plates to capture *E. coli* for 10 minutes wherein each aperture for each adjacent plate is misaligned at a misalignment value of 40% (for comparison purposes only since misalignment greater than 40% is not previously disclosed in the above-identified references for Metal Catalyst Air Cleaners), and (b) an air cleaner device having 2, 4, 6, and 8 layers of dielectric conducting and antimicrobial agent polymer material coated metallic apertured air filter plates to capture *E. coli* for 3 minutes wherein the apertures for each plate are misaligned at a misalignment value of 40%; and (2) (a) an air cleaner device having 2, 4, 6, and 8 layers of uncoated metallic apertured air filter plates to capture *Aspergillus niger* for 10 minutes wherein each aperture for each adjacent plate is misaligned at a misalignment value of 40% (for comparison purposes only since misalignment greater than 40% is not previously disclosed in the above-identified references for Metal Catalyst Air Cleaners), and (b) an air cleaner device having 2, 4, 6, and 8 layers of dielectric conducting and antimicrobial agent polymer material coated metallic apertured air filter plates to capture *Aspergillus niger* for 3 minutes wherein the apertures for each plate are misaligned at a misalignment value of 40%.

TABLE 1

| Microbes | Polymer Coated | Initial load (cfu) | Treatment time (min) | Capture rates (%) 2 layers | 4 layers | 6 layers | 8 layers |
|---|---|---|---|---|---|---|---|
| *E. coli* | No | $10^7$ | 10 | 3.7 | 10.7 | 14.6 | 21.1 |
| | Yes | | 3 | 17.2 | 23.7 | 42.1 | 59.9 |
| *Aspergillus niger* | No | $10^7$ | 10 | 6.0 | 11.9 | 16.5 | 19.1 |
| | Yes | | 3 | 11.0 | 21.6 | 40.4 | 56.4 |

Table 1 conveys the capture rates of 2 distinct microbes, *E. coli* and *Apergillus niger,* with and without an dielectric conducting and antimicrobial agent polymer material coating at a log $10^7$ initial loading. The dielectric conducting and antimicrobial agent polymer material coated filters have a significantly higher capture rate with a lower treatment time, and the same aperture misalignment configuration. The information conveyed in Table 1 confirms the superiority of the claimed invention over other air cleaner devices' using static electricity to capture microbes.

The dielectric conducting, antimicrobial polymer material is prepared, for example in the following ratio, as follows: five grams of poly powder (ethylene oxide) was added into the 100 ml heated water (at or around 40° C.) with stirring till the polymer solution was stable. Five grams of ammonium persulfate—an antimicrobial agent—was added into the polymer solution with 1 drop of 5% polypyrrole to render the polymeric material a dielectric conducting, antimicrobial polymer material. Then each metallic apertured air filter plate was soaked into the matric solution and held for 20 minutes. Each coated metallic apertured air filter plate was dried for 1 hour in air.

Alternatively, the dielectric conducting, antimicrobial polymer material can be applied by powder coating techniques that do not adversely effect the antimicrobial characteristics of the dielectric conducting, antimicrobial polymer material. Examples of such conventional powder coating techniques are disclosed in Wikipedia and portions thereof read as follows: "There are two main categories of powder coating: thermosets and thermoplastics. The thermosetting variety incorporates a cross-linker into the formulation. When the powder is baked, it reacts with other chemical groups in the powder to polymerize, improving the performance properties. The thermoplastic variety does not undergo any additional actions during the baking process as it flows to form the final coating. The most common polymers used are: polyester, polyurethane, polyester-epoxy, straight epoxy and acrylic.

Whichever powder coating category is used, the following production techniques are required: The dielectric conducting, antimicrobial polymer material granules are mixed with a conventional hardener . . . and other potential powder ingredients in a mixer. The mixture is heated in an extruder. The extruded mixture is rolled flat, cooled and broken into small chips. And the chips are milled and sieved to make a fine powder.

The powder coating process involves three basic steps: [First, removing] oil, dirt, lubrication greases, metal oxides, welding scale prior to the powder coating process . . . . The pretreatment process both cleans and improves bonding of the powder to the metal . . . . Another method of preparing the surface prior to coating is known as abrasive blasting or sandblasting and shot blasting. Blast media and blasting abrasives are used to provide surface texturing and preparation, etching, finishing, and degreasing for products made of wood, plastic, or glass. The most important properties to consider are chemical composition and density; particle shape and size; and impact resistance. Silicon carbide grit blast medium is brittle, sharp, and suitable for grinding metals and low-tensile strength, non-metallic materials . . . . Sand blast medium uses high-purity crystals that have low-metal content. Glass bead blast medium contains glass beads of various sizes. Cast steel shot or steel grit is used to clean and prepare the surface before coating. Shot blasting recycles the media and is environmentally friendly . . . . Different powder coating applications can require alternative methods of preparation such as abrasive blasting prior to coating. The online consumer market typically offers media blasting services coupled with their coating services at additional costs. [Second, the] most common way of applying the powder coating to metal objects is to spray the powder using an electrostatic gun, or corona gun. The gun imparts a positive electric charge to the powder, which is then sprayed towards the grounded object by mechanical or compressed air spraying and then accelerated toward the workpiece by the powerful electrostatic charge. There is a wide variety of spray nozzles available for use in electrostatic coating. The type of nozzle used will depend on the shape of the workpiece to be painted and the consistency of the paint. The object is then heated, and the powder melts into a uniform film, and is then cooled to form a hard coating. It is also common to heat the metal first and then spray the powder onto the hot substrate. Preheating can help to achieve a more uniform finish but can also create other problems, such as runs caused by excess powder . . . . Another type of gun is called a tribo gun, which charges the powder by friction. In this case, the powder picks up a positive charge while rubbing along the wall of a Teflon tube inside the barrel of the gun. These charged powder particles then adhere to the grounded substrate. Using a tribo gun requires a different formulation of powder than the more common corona guns. Tribo guns are not subject to some of the problems associated with corona guns, however, such as back ionization and the Faraday cage effect . . . . Powder can also be applied using specifically adapted electrostatic discs. Another method of applying powder coating, named as the fluidized bed method, is by heating the substrate and then dipping it into an aerated, powder-filled bed. The powder sticks and melts to the hot object. Further heating is usually required to finish curing the coating. This method is generally used when the desired thickness of coating is to exceed 300 micrometres . . . . Electrostatic fluidized bed application uses the same fluidizing technique as the conventional fluidized bed dip process but with much less powder depth in the bed. An electrostatic charging medium is placed inside the bed so that the powder material becomes charged as the fluidizing air lifts it up. Charged particles of powder move upward and form a cloud of charged powder above the fluid bed. When a grounded part is passed through the charged cloud the particles will be attracted to its surface. The parts are not preheated as they are for the conventional fluidized bed dip process. A coating method for flat materials that applies powder with a roller, enabling relatively high speeds and accurate layer thickness between 5 and 100 micrometers. The base for this process is conventional copier technology. It is currently in use in some coating applications [in particular] commercial powder coating on flat substrates (steel, . . . ) as well as in sheet to sheet and/or roll to roll processes. This process can potentially be integrated in an existing coating line . . . . [Third, when] a thermoset powder is exposed to elevated temperature, it begins to melt, flows out, and then chemically reacts to form a higher molecular weight polymer in a network-like structure. This cure process, called crosslinking, requires a certain temperature for a certain length of time in order to reach full cure and establish the full film properties for which the material was designed. Normally the powders cure at 200° C. for 10 minutes. The curing schedule could vary according to the manufacturer's specifications. The application of energy to the product to be cured can be accomplished by convection cure ovens, infrared cure ovens, or by laser curing process. The latter demonstrates significant reduction of curing time."

Obviously, the above-identified specific antimicrobial agent and dielectric inducing material are examples of the materials that can be used in the present invention to obtain the desired result. For example the polymeric material can be polyaniline, polyacetylene, polythiophene, fluorophenylthiophene, polypyrrole, and combinations thereof. The antimicrobial agent can be ammonium persulfate, potassium persulfate, disuccinic peroxide, and combinations thereof.

Figure 1:
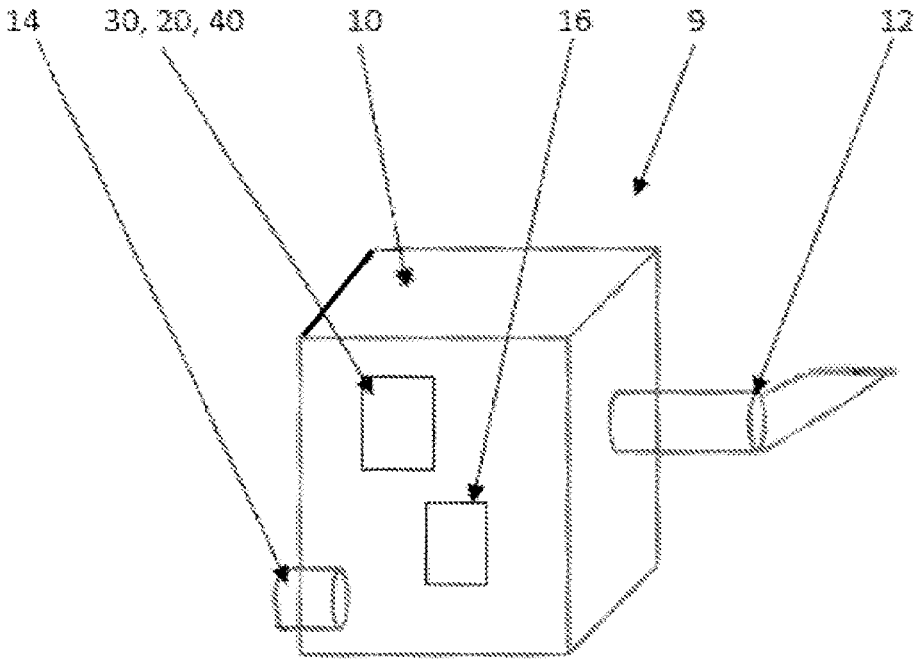
FIG. 1 is an illustration of an electronic air cleaner device.

Two or more of the coated metallic apertured air filter plates in a misalignment configuration, above a 50% misalignment configuration, (see, FIGS. 2 and 4) are positioned in an air cleaning housing 10 (see, FIG. 1). The air cleaning housing 10 has to have an inlet 12, an outlet 14 and a support frame bus unit 30 that (a) holds and secures the coated metallic aperture filter plates 20, 40 in a proper position in the air cleaning housing 10.

When securely and properly positioned in the air cleaning housing 10, the coated electrically charged air filter metallic plates capture the air-borne particulates through passive electrostatic attraction (a.k.a., static electricity), as well as mechanical impingement, interception, and diffusion. The static electricity is generated from air movement through the air cleaning housing 10, the coated metallic apertured air filter plates, and a heating, ventilation, and air conditioning (HVAC) ducting.

The air cleaning housing 10 can have a fan/motor 16 that pushes or pulls air (a) into the inlet 12; (b) past the coated metallic apertured air filter plates as illustrated in representative configurations at FIGS. 2 and 4, and (c) through the outlet 14. Alternatively, the housing 10 need not have the fan/motor 16. Instead, the fan/motor 16 can be positioned in another device, for example a HVAC unit, wherein (a) the housing 10 is, for example, interconnected to ductwork, (b) the HVAC unit has a fan/motor 16 that pushes or pulls air through the ductwork, and (c) the HVAC unit's fan/motor 16 pushes or pulls air (i) into the inlet 12; (ii) past the coated metallic apertured air filter plates as illustrated in representative configurations at FIGS. 2 and 4, and (iii) through the outlet 14.

Obviously, if there is a fan/motor 16 in the housing 10, then air cleaning housing 10 and the fan/motor 16 interconnect to a conventional electrical source (not shown) by conventional methods, like electrical wires, that are obvious to those having ordinary skill in the art.

There is at least one support frame bus unit 30 (see, FIG. 2) in the air cleaning housing 10—that means there can be one support frame bus unit 30 in the air cleaning housing 10 or more than one support frame bus unit 30 in the air cleaning housing 10. Each support frame bus unit 30 in the air cleaning housing 10 has at least one slot 90 to receive a coated metallic apertured air filter plate that can be used in the air cleaning housing 10. The slot secures the coated metallic apertured air filter plate in a position in the air cleaning housing 10 so that when air enters the inlet 12, the air must pass through the coated metallic apertured air filter plate.

Obviously, the support frame bus unit 30 can have more than one slot. If the support frame bus unit 30 has more than one slot (as illustrated at FIG. 2), then (1) a coated metallic apertured air filter plate is positioned in each slot of the support frame bus unit 30 (as illustrated at FIG. 2); (2) a coated metallic apertured air filter plate is (i) positioned in at least one slot of the support frame bus unit 30 and (ii) not positioned in at least one slot in the support frame bus unit 30; or (3) no coated metallic apertured air filter plate is positioned in any slot of the support frame bus unit 30. The third option—"no coated metallic apertured air filter plate is positioned in any slot of the support frame bus unit 30"—can occur, for example, when the coated metallic apertured air filter plate(s) is/are being cleaned.

As alluded above, when a coated metallic apertured air filter plate is properly positioned in the slot 90 in the support frame bus unit 30, then the coated metallic apertured air filter plate (a) is in a position in the air cleaning housing 10 so that when air enters the inlet 12, the air must pass through each and every coated metallic apertured air filter plate positioned in the housing 10 prior to exiting the outlet 14, and (b) is or becomes electrically charged through static electricity. The static electricity on each coated metallic apertured air filter plate is generated from air movement through the air cleaning housing 10, the coated metallic apertured air filter plates, and a heating, ventilation, and air conditioning (HVAC) ducting. Only then is the polymerized metal catalyst air cleaner device 9 set up to perform as desired—clean air that passes through the air cleaning housing 10.

Unlike other electronic air cleaner devices, the current invention has no media positioned between any coated metallic apertured air filter plates or positioned against any coated metallic aperture air filter plate in the housing 10. In particular, between the metallic plates is a gaseous space and the gaseous space is (a) free of any liquid filter media, solid filter media and combinations thereof, and (b) configured to contain air-borne particulates captured by the filter unit of the coated metallic apertured air filter plates, if the air-borne particulates are somehow dislodged from the preferred location of being trapped and/or captured on the metallic aperture filter plates—but which could occur as a result of gravity or other known forces.

The air cleaning housing 10 has at a minimum two coated metallic apertured air filter plates, and a portion of each coated metallic apertured air filter plate contacts, butts against, or is within 20 millimeters from an adjacent coated metallic apertured air filter plate. The term "portion" is used because the coated metallic apertured air filter plates are, as described above, expanded metal. The apertures (a.k.a., openings) of the coated metallic apertured air filter plates can have a "unique diamond pattern opening with one of the strands 99 protruding at a slight angle." Those protruding strands 99 at a slight angle on the coated metallic apertured air filter plates is why the term "portion", rather than the entire plate, is used in defining the distance between the coated metallic apertured air filter plates since the strands 99 are the portion of the coated metallic aperture air filter plates that most likely contacts, butts against or is within 20 millimeters from an adjacent coated metallic aperture air filter plate. Those protruding strands 99 on the coated metallic apertured air filter plates are also beneficial since those strands 99 increase the turbulence between the coated metallic apertured air filter plates properly positioned in the respective slot 90 for each coated metallic aperture air filter plate in the support frame bus unit 30. That increased turbulence is desired between the coated metallic apertured air filter plates to increase the filtering capability of the polymerized metal catalyst air cleaner device 9.

It is understood that the polymerized metal catalyst air cleaner device 9 can have conventional pre-filter device positioned anywhere prior to the air stream that (a) passes through the polymerized metal catalyst air cleaner device 9 and (b) contacts the coated metallic apertured air filter plates. The conventional pre-filter device, as described above, can contain a foam pre-filter, wherein the pre-filter removes large air-borne particulates such as dust and dander from the air stream in the polymerized metal catalyst air cleaner device 9. The pre-filter device could also be, alternatively, in the above-identified ductwork and/or above-identified HVAC unit.

The coated metallic apertured air filter plates capture or trap (in addition to charging the air stream particulates) microbial cells and then inactivate those cells through a combination of copper ions and antimicrobials within the dielectric layer. The performance of the present filters (coated metallic apertured air filter plates) were assessed through determining the capture efficacy of microbes under different flow rates, relative humidity and organic loading. The coated metallic apertured air filter plate configuration and holding potential were optimized along with an antimicrobial agent incorporated into the dielectric layer. As previously expressed, the potential restriction of copper based coated metallic apertured air filter plates is that such copper filters undergo excessive corrosion and that corrosion is addressed by the polymer layers. The performance of the optimized polymerized metal catalyst air cleaner device 9 having coated metallic apertured air filter plates were assessed through verification studies with a cost-benefit analysis being performed in relation to currently available HEPA filter systems.

The study evaluated the capture ability of novel air purification chamber having multi-layer coated metallic apertured air filter plates wherein each coated metallic apertured air filter plates has a coating with antimicrobial polymers. Under the consistent flow rates and relative humidity, an 8-layer coated metallic apertured air filter plate in a mis-aligned (greater than a 40% misalignment configuration) or non-aligned configuration displayed significant (P<0.05) 18-23% capture rates for *E. coli* and *Aspergillus niger*. The extent of microbial cells captured was independent on cell density within the air (5 and 7 log cfu) or treatment time (1 or 10 min.). The deposition of a conducting polymer film on the surface of the coated metallic apertured air filter plates significantly increased the capture efficiency by up to 66%. All tested bacteria and fungi (*E. coli, Salmonella enterica, Listeria monocytogenes, Staphylococcus aureus, Aspegillus niger, Clostridium perfringens* and *Bacillius subtilis*) showed similar capture rates suggesting cell size was a main factor on filter efficiency. Although the modified coated metallic apertured air filter plates could be used to capture microbes the performance was less than that of traditional HEPA filters but significantly greater than conventional electronic air filters.

Methods

Determination of the Capture Efficacy of the Copper Layers by Comparing the Counts of Microbe on the Sample Plates The tested microorganisms were *E. coli* and *Aspegillus niger*. The tested microbes were individually cultivated in tryptic soy broth (TSB) containing 1% glucose and adjusted to 8 log CFU/ml. The cultures were held at 4° C. for 48 h to increase intrinsic stress resistance. All cultures were diluted 10 or 1000 folds to a final concentration of 7 or 5 log CFU/ml.

The air chamber was set up (see, FIG. 1) and the flow rate and relative humidity after 1 min running was measured. A clean plate was attached at the exit of the chamber and 1 ml of 7 or 5 log CFU/ml individual culture was spray inoculated through the entrance of the chamber. After inoculation, the chamber was kept working on different periods then the samples were collected on the attached plates. To evaluate the layers of coated metallic apertured air filter plates in a mis-aligned configuration (greater than a 40% misalignment configuration) or a non-alignment configuration capture efficacy, two working periods (1 min and 10 min) and 5 different coated metallic apertured air filter plate configurations (0 layer, 2 layer, 4 layer, 6 layer, and 8 layer) were tested.

The capture rate was calculated with equation (1):

$$\text{Capture rate} = \left(1 - \frac{\text{collected cells on exit with copper filter}}{\text{collected cells on exit without copper filter}}\right) \times 100\% \quad (1)$$

Evaluation of the Antimicrobial Activity of the Copper Filter Coating with Polymers The tested microorganisms were *E. coli, Salmonella enterica, Listeria monocytogenes, Staphylococcus aureus, Aspegillus niger, Clostridium perfringens* and *Bacillius subtilis*. The four typical vegetative bacteria, two endospores, and one spore-forming fungi were performed to mimic the air contamination in nature. The tested microbes were individually cultivated in tryptic soy broth (TSB) containing 1% glucose and adjusted to 8 log CFU/ml. The cultures were held at 4° C. for 48 h to increase intrinsic stress resistance. All cultures were diluted 10 folds to a final concentration of 7 log CFU/ml.

The air cleaning housing 10 was set up and measured the flow rate and relative humidity after 1 min running. A clean plate was attached at the exit of the air cleaning housing 10 and 1 ml of 7 log CFU/ml individual culture was spray inoculated through the inlet 12 of the air cleaning housing 10. After inoculation, the polymerized metal catalyst air cleaner device 9 was kept working on different periods then the samples were collected on the attached coated metallic apertured air filter plate. To evaluate the antimicrobial activity of the coated metallic apertured air filter plates, 4 working periods (30 s, 60 s, 90 s, and 180 s) and 5 different layers of coated metallic apertured air filter plates in a mis-align (greater than a 40% misalignment configuration) and/or non-alignment configuration (0 layer, 2 layers, 4 layers, 6 layers, and 8 layers) were tested.

Results

Determination of the Capture Efficacy of the Copper Filters

The consistent flow rate and relative humidity were measured (see, Table 2).

TABLE 2

Air flow rates and relative humidity measured of air purification chamber

| Measurement | Air flow rate (m/s) | | Relative humidity (%) | |
|---|---|---|---|---|
| position | No Plate | Plates | No Plate | Plates |
| Position 1 | 4.5 | 2.5 | 61 | 61 |
| Position 2 | 8.6 | 6.5 | 61 | 61 |
| Position 3 | 7.6 | 2.8 | 61 | 61 |
| Position 4 | 3.5 | 2.8 | 61 | 61 |
| Position 5 | 12.7 | 6.0 | 61 | 61 |

The numbers of *E. coli* and *Aspergillus niger* through various layers of coated metallic apertured air filter plate in a misaligned (greater than a 40% misalignment configuration) and/or non-alignment configuration with different initial loading (5 or 7 log cfu) and treatment time (1 or 10 min.) have been presented at FIGS. 5(A-D).

In general, around 2-3 log of tested microbes were collected from the exit of the air purification system. The addition of coated metallic apertured air filter plates slightly and significantly (P<0.05) caused 0.09-0.11 log reduction of test microbes when 8 layers of coated metallic apertured air filter plates were applied. There were no significant (P>0.05) difference between the initial loading and the treatment time.

For *E. coli*, the capture rates were determined as 22.6% and 17.9% for initial loading of $10^5$ cfu with 1 minute treatment, and 22.4% and 21.1% for initial loading of $10^5$ cfu with 10 minute treatment. For *Aspergillus niger*, the capture rates were determined as 19.5% and 23.2% for initial loading of $10^7$ cfu with 1 minute treatment, and 22.1% and 19.1% for initial loading of $10^7$ cfu with 10 minute treatment (see, Table 3).

TABLE 3

Microorganism capture rates of the multi-layer coated metallic apertured air filter plates

| Microbes | Initial load (cfu) | Treatment time (min) | Capture rates (%) 2 layers | 4 layers | 6 layers | 8 layers |
|---|---|---|---|---|---|---|
| *E. coli* | $10^5$ | 1 | 20.5 | 17.2 | 17.4 | 22.6 * |
| | | 10 | 16.5 | 17.2 | 14.0 | 17.9 * |
| | $10^7$ | 1 | 6.0 | 11.2 | 17.9 | 22.4 * |
| | | 10 | 3.7 | 10.7 * | 14.6 * | 21.1 * |
| *Aspergillus niger* | $10^5$ | 1 | 7.2 * | 8.4 | 16.8 * | 19.5 * |
| | | 10 | 5.8 | 11.1 * | 15.4 | 23.2 * |
| | $10^7$ | 1 | 3.4 | 3.3 | 11.5 | 22.1 * |
| | | 10 | 6.0 | 11.9 | 16.5 * | 19.1 * |

* Significant difference ($P < 0.05$) between treatment and control (0 layers) values

Evaluation of the Antimicrobial Activity of the Copper Filter Coated with the Polymer Layer FIGS. 6(A-G) showed the survived microorganisms (*E. coli, Salmonella enterica, Listeria monocytogenes, Staphylococcus aureus, Aspegillus niger, Clostridium perfringens* and *Bacillius subtilis*) after passing through the layers of coated metallic apertured air filter plate in a misaligned and/or non-alignment configuration. The overall trends were that the absorbed cells increased along with the prolonged treatment time and increased number of coated metallic apertured air filter plate layers. The significant ($P<0.05$) log-reductions were observed in most tested microbes when applying 6-layers of coated metallic apertured air filter plate in a misaligned and/or non-alignment configuration with treatment for 180 seconds and in all tested microbes when applying 8-layers of coated metallic apertured air filter plates in a misaligned or non-alignment configuration. Up to 0.66 log reduction can be achieved using polymer layer coating technique.

The capture rates of *E. coli, Salmonella enterica, Listeria monocytogenes, Staphylococcus aureus, Aspegillus niger, Clostridium perfringens* and *Bacillius subtilis* when applying 8-layers of coated metallic apertured air filter plates in a misaligned and/or non-alignment configuration are 59.9%, 48.6%, 60.4%, 66.2%, 56.4%, 62.1%, and 60.9%, respectively (see, Table 4).

TABLE 4

Microorganism capture rates of the copper filters coated with polymer layers

| Microbes | Capture rates (%) 2 layers | 4 layers | 6 layers | 8 layers |
|---|---|---|---|---|
| *E. coli* | 17.2 | 23.7 | 42.1 | 59.9 * |
| *Salmonella enterica* | 9.8 | 15.6 | 38.2 | 48.6 * |
| *Listeria monocytogenes* | 25.8 | 40.1 | 45.9 | 60.4 * |
| *Staphylococcus aureus* | 21.5 | 33.0 | 49.8 * | 66.2 * |
| *Aspergillus niger* | 11.0 | 21.6 | 40.4 * | 56.4 * |
| *Clostridia perfringens* | 7.0 * | 21.2 | 42.0 * | 62.1 * |
| *Bacillus subtilis* | 6.7 | 26.9 | 38.6 * | 60.9 * |

* Significant difference ($P < 0.05$) between treatment and control (0 layer) values The responses of test microbes in a HEPA filter were tested. The cells passing through the HEPA filter were not detected.

Misaligning the filter plates is to increase the chances of mechanical filtration mechanisms (impingement, interception, and diffusion) of occurring. Impingement occurs by changing the direction of the air flow causing the particles to be carried into the filter strands due to their momentum (i.e., speed, weight, size).

Interception occurs by changing the direction of the air flow as well. The smaller particles will follow the air steam but still come into contact with the filter strand as it passes round it.

Diffusion (Brownian Motion) occurs when very small particles have an erratic path caused by being bombarded by other molecules in the air. The erratic path of the particles increases the chance that they will be captured by the filter strands.

Although the preferred embodiment has been described in detail, it should be understood that various changes, substitutions and alterations can be made therein without departing from the spirit and scope of the invention as defined by the appended claims.

The invention claimed is:

1. A method of making an electronic air filter comprising:

obtaining a first metallic plate comprising copper and having a thickness of 10 microns to 10 millimeters and a second metallic plate comprising copper and having a thickness of 10 microns to 10 millimeters;

creating a first pattern of slits through the first metallic plate's thickness and a second pattern of slits through the second metallic plate's thickness and expanding (a) the first slitted metallic plate to form a first aperture metallic plate and (b) the second slitted metallic plate to form a second aperture metallic plate wherein when the first aperture metallic plate and the second aperture metallic plate are properly aligned and positioned in an electronic air cleaner device then the apertures in the first aperture metallic plate and the apertures in the second aperture metallic plate misalign with each other;

applying a dielectric conducting and antimicrobial agent polymer material to (a) the first aperture metallic plates to form a first coated, aperture metallic plate and (b) the second aperture metallic plates to form a second coated, aperture metallic plate; and positioning the first and second coated, aperture metallic plates into the electronic air cleaner device, the electronic air cleaner device has a housing (a) having an inlet, a filter unit, a frame unit and an outlet, and (b) subjected to the influences of a fan, wherein the fan pulls or pushes air (i) into the inlet, and (ii) through the outlet, and has the air pass through the filter unit;

the frame unit (a) secures the first coated, aperture metallic plate at a first position in the housing, (b) secures the second coated, aperture metallic plate at a second position in the housing, (c) ensures, when the first and second coated, aperture metallic plates are securely positioned in the housing, the first coated, aperture metallic plate is adjacent to the second coated, aperture metallic plate and wherein a portion of the first coated, aperture metallic plate contacts or is within 20 millimeters from the second coated, aperture metallic plate so that static electricity is generated on the first and second coated, aperture metallic plates when air passes the first and second coated, aperture metallic plates, and the first and second coated, aperture metallic plates captures air borne particulates from the air.

2. The method of claim 1 wherein at least one of the apertures in the first aperture metallic plate has a strand.

3. The method of claim 2 wherein at least one of the apertures in the second aperture metallic plate has a strand.

4. The method of claim 1 wherein at least one of the apertures in the second aperture metallic plate has a strand.

5. The method of claim 1 wherein the dielectric conducting and antimicrobial agent polymer layer is prepared by adding a poly powder into a heated water;

stirring the polymer solution until stable;

adding an antimicrobial agent to the stable polymer solution with polypyrrole.

6. The method of claim 1, wherein the dielectric conducting and antimicrobial agent polymer layer is prepared by adding a predetermined amount of poly powder into a predetermined quantity of heated water;

stirring the polymer solution until stable;

adding a known quantity of antimicrobial agent to the stable polymer solution with a low amount of polypyrrole.

7. The method of claim 1 wherein between the first and second metallic plates is a gaseous space, the gaseous space is (a) free of any liquid filter media, solid filter media and combinations thereof, and (b) configured to contain airborne particulates captured by the filter unit.

8. The method of claim 1 wherein the first expanded metal metallic plate has a first dimension in length, width and thickness and the second expanded metal metallic plate has a second dimension in length, width and thickness of which up to two of the three dimensions in the first and second dimensions can be the same.

9. A method of making an electronic air filter comprising:

obtaining a first metallic plate comprising copper and having a thickness of 10 microns to 10 millimeters and a second metallic plate comprising copper and having a thickness of 10 microns to 10 millimeters;

creating a first pattern of slits through the first metallic plate's thickness and a second pattern of slits through the second metallic plate's thickness and expanding (a) the first slitted metallic plate to form a first aperture metallic plate and (b) the second slitted metallic plate to form a second aperture metallic plate wherein when the first aperture metallic plate and the second aperture metallic plate are properly aligned and positioned in an electronic air cleaner device then the apertures in the first aperture metallic plate and the apertures in the second aperture metallic plate do not align with each other;

applying a dielectric conducting and antimicrobial agent polymer material to (a) the first aperture metallic plates to form a first coated, aperture metallic plate and (b) the second aperture metallic plates to form a second coated, aperture metallic plate; and positioning the first and second coated, aperture metallic plates into the electronic air cleaner device, the electronic air cleaner device has a housing (a) having an inlet, a filter unit, a frame unit and an outlet, and (b) subjected to the influences of a fan, wherein the fan pulls or pushes air (i) into the inlet, and (ii) through the outlet, and has the air pass through the filter unit; the frame unit (a) secures the first coated, aperture metallic plate at a first position in the housing, (b) secures the second coated, aperture metallic plate at a second position in the housing, (c) ensures, when the first and second coated, aperture metallic plates are securely positioned in the housing, the first coated, aperture metallic plate is adjacent to the second coated, aperture metallic plate and wherein a portion of the first coated, aperture metallic plate contacts or is within 20 millimeters from the second coated, aperture metallic plate so that static electricity is generated on the first and second coated, aperture metallic plates when air passes the first and second coated, aperture metallic plates, and the first and second coated, aperture metallic plates captures air borne particulates from the air.

10. The method of claim 9 wherein at least one of the apertures in the first aperture metallic plate has a strand.

11. The method of claim 10 wherein at least one of the apertures in the second aperture metallic plate has a strand.

12. The method of claim 9 wherein at least one of the apertures in the second aperture metallic plate has a strand.

13. The method of claim 9 wherein the dielectric conducting and antimicrobial agent polymer layer is prepared by adding a poly powder into a heated water;

stirring the polymer solution until stable;

adding an antimicrobial agent to the stable polymer solution with polypyrrole.

14. The method of claim 9, wherein the dielectric conducting and antimicrobial agent polymer layer is prepared by adding a predetermined amount of poly powder into a predetermined quantity of heated water;

stirring the polymer solution until stable;

adding a known quantity of antimicrobial agent to the stable polymer solution with a low amount of polypyrrole.

15. The method of claim 9 wherein between the first and second metallic plates is a gaseous space, the gaseous space is (a) free of any liquid filter media, solid filter media and combinations thereof, and (b) configured to contain airborne particulates captured by the filter unit.

16. The method of claim 9 wherein the first expanded metal metallic plate has a first dimension in length, width and thickness and the second expanded metal metallic plate has a second dimension in length, width and thickness of which up to two of the three dimensions in the first and second dimensions can be the same.

17. A method of making an electronic air filter comprising:

obtaining a first metallic plate comprising copper and having a thickness of 10 microns to 10 millimeters and a second metallic plate comprising copper and having a thickness of 10 microns to 10 millimeters;

creating a first pattern of slits through the first metallic plate's thickness and a second pattern of slits through the second metallic plate's thickness and expanding (a) the first slitted metallic plate to form a first aperture metallic plate and (b) the second slitted metallic plate to form a second aperture metallic plate wherein when the first aperture metallic plate and the second aperture metallic plate are properly aligned and positioned in an electronic air cleaner device then the apertures in the first aperture metallic plate and the apertures in the second aperture metallic plate misalign or do not align with each other; and applying a dielectric conducting and antimicrobial agent polymer material to (a) the first aperture metallic plates to form a first coated, aperture metallic plate and (b) the second aperture metallic plates to form a second coated, aperture metallic plate.

18. The method of claim 17 wherein at least one of the apertures in the first aperture metallic plate has a strand.

19. The method of claim 18 wherein at least one of the apertures in the second aperture metallic plate has a strand.

20. The method of claim 17 wherein at least one of the apertures in the second aperture metallic plate has a strand.

* * * * *